US008251724B2

(12) United States Patent
Lee et al.

(10) Patent No.: US 8,251,724 B2
(45) Date of Patent: Aug. 28, 2012

(54) LAMP SOCKET AND DISPLAY DEVICE HAVING THE SAME

(75) Inventors: Sang-Hyeok Lee, Cheonan-si (KR); Jae-Hwan Chun, Suwon-si (KR); Jung-Ki Kim, Cheonan-si (KR); Hyun-Su Park, Suwon-si (KR); Jae-Sang Lee, Cheonan-si (KR); Jeong-Ki Kim, Asan-si (KR); Ki-Hwan Baek, Asan-si (KR); Kyu-Hun Shim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 58 days.

(21) Appl. No.: 12/645,407

(22) Filed: Dec. 22, 2009

(65) Prior Publication Data

US 2010/0173540 A1 Jul. 8, 2010

(51) Int. Cl.
*H01R 33/02* (2006.01)

(52) U.S. Cl. ..... 439/232; 439/257; 439/669

(58) Field of Classification Search ..... 439/232, 439/257, 669

See application file for complete search history.

(56) References Cited

U.S. PATENT DOCUMENTS

| | | | | |
|---|---|---|---|---|
| 3,660,803 | A * | 5/1972 | Cooney | 439/637 |
| 5,957,731 | A * | 9/1999 | Nishihara et al. | 439/698 |
| 6,276,946 | B1 * | 8/2001 | Stephan | 439/83 |
| 6,692,309 | B1 * | 2/2004 | Kovacs | 439/699.2 |
| 7,413,456 | B1 * | 8/2008 | DiFusco | 439/257 |
| 7,806,709 | B2 * | 10/2010 | Yang et al. | 439/232 |
| 7,810,943 | B2 * | 10/2010 | Ko et al. | 362/97.2 |
| 2008/0102711 | A1 * | 5/2008 | Yang et al. | 439/660 |

FOREIGN PATENT DOCUMENTS

| | | | |
|---|---|---|---|
| KR | 100540214 | B1 | 12/2005 |
| KR | 1020080013562 | A | 2/2008 |
| KR | 1020080016190 | A | 2/2008 |
| KR | 100818156 | B1 | 3/2008 |

* cited by examiner

*Primary Examiner* — Truc Nguyen

(74) *Attorney, Agent, or Firm* — Innovation Counsel LLP

(57) ABSTRACT

Provided are a lamp socket structured to realize a slimmer display device, and a display device having the lamp socket. The lamp socket includes: a body portion; a connection terminal for connection of the lamp socket to a terminal of a lamp; a compliant portion which connects the body portion and the connection terminal and includes a first portion connected to the connection terminal and a second portion connected to the body portion; and one or more fixing portions which extend from the body portion, wherein the first portion and the second portion at least partially overlap each other.

12 Claims, 11 Drawing Sheets

LAMP SOCKET AND DISPLAY DEVICE HAVING THE SAME

This application claims priority to Korean Patent Application No. 10-2009-0001560 filed on Jan. 8, 2009 in the Korean Intellectual Property Office, the disclosure of which is incorporated herein by reference in its entirety.

BACKGROUND OF THE INVENTION

1. Field of the Invention

The present disclosure relates generally to flat panel displays. More specifically, the present disclosure relates to a lamp socket and a display device for use in flat panel displays.

2. Description of the Related Art

Liquid crystal displays (LCDs) are among the most widely used types of flat panel displays. Generally, an LCD includes a pair of substrates having electrodes, and a liquid crystal layer interposed between the substrates. In an LCD, voltages are applied to electrodes to generate an electric field. This electric field aligns molecules of the liquid crystal. As a result, a desired image is displayed on the LCD.

Being non-self-luminous, LCDs commonly utilize a backlight assembly, which includes light sources (i.e., light-emitting devices), to display an image. A backlight assembly provides a light source illuminating the display panel from behind, often providing uniform light to the entire surface of the display panel. Backlight assemblies are often classified into direct-type backlight assemblies and edge-type backlight assemblies, according to the positions of their light sources. In direct-type backlight assemblies, light sources are disposed directly behind a display panel. In edge-type backlight assemblies, light sources are disposed behind one or more sides of a display panel, and light emitted from the light sources is delivered to the entire display panel using a light guide plate.

Recently, a lot of research is being conducted to develop large and ultra-slim display devices. In display devices with direct-type backlight assemblies, light sources are typically disposed under a diffusion plate. Thus, it is structurally difficult to make the display device as slim as desired. In particular, the thickness of display devices with direct-type backlight assemblies is greatly affected by the shape and arrangement of lamps (i.e., light sources) and the way in which the lamps are fixed to lamp sockets.

SUMMARY OF THE INVENTION

Aspects of the present invention provide a lamp socket structured to realize an ultra-slim display device.

Aspects of the present invention also provide a display device having a lamp socket structured to realize an ultra-slim display device.

However, aspects of the present invention are not restricted to those set forth herein. The above and other aspects of the present invention will become more apparent to one of ordinary skill in the art to which the present invention pertains by referencing the detailed description of the present invention given below.

According to an aspect of the present invention, there is provided a lamp socket including: a body portion; a connection terminal for connection of the lamp socket to a terminal of a lamp; a compliant portion which connects the body portion and the connection terminal and includes a first portion connected to the connection terminal and a second portion connected to the body portion; and one or more fixing portions which extend from the body portion, wherein the first portion and the second portion at least partially overlap each other.

According to another aspect of the present invention, there is provided a display device including: a lamp configured to emit light; a circuit board; a lamp socket mounted on the circuit board; and a housing supporting the circuit board and the lamp socket, wherein the lamp socket includes: a body portion; a connection terminal for connection of the lamp socket to a terminal of the lamp; a compliant portion which connects the body portion and the connection terminal and includes a first portion connected to the connection terminal and a second portion connected to the body portion; and one or more fixing portions which extend from the body portion, wherein the first portion and the second portion at least partially overlap each other.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION OF THE INVENTION

Figure 1:
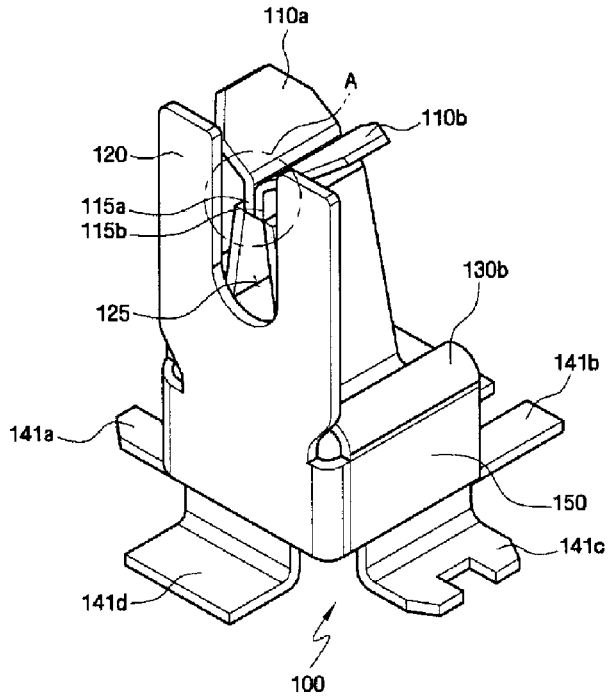
FIG. 1 is a first perspective view of a lamp socket according to a first exemplary embodiment of the present invention.

Advantages and features of the present invention and methods of accomplishing the same may be understood more readily by reference to the following detailed description of exemplary embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 2:
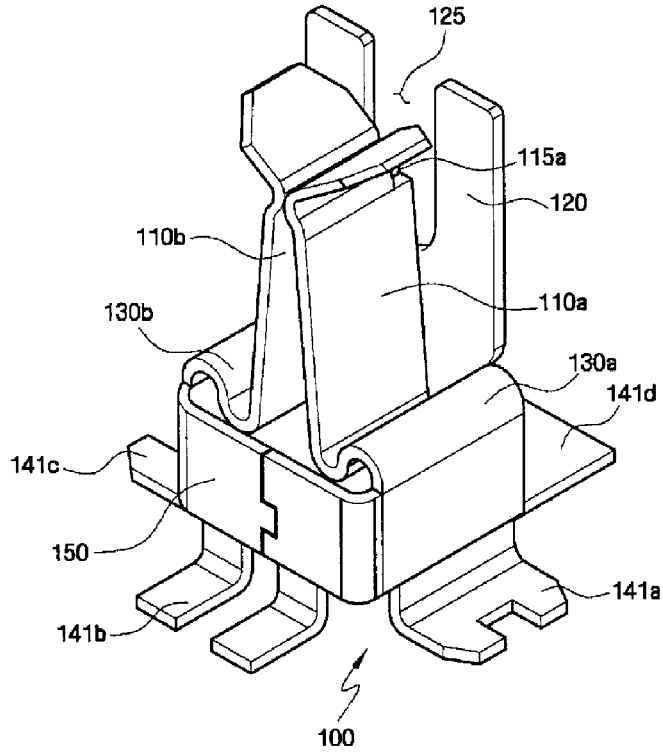
FIG. 2 is a second perspective view of the lamp socket shown in FIG. 1.
Figure 3:
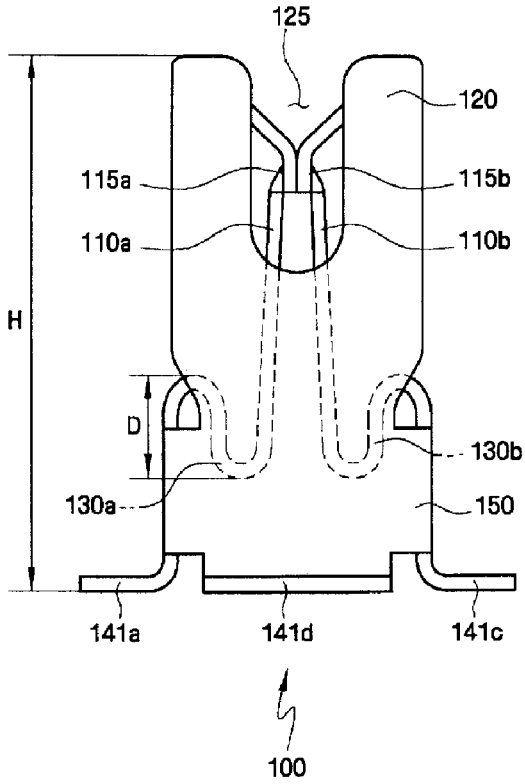
FIG. 3 is a front view of the lamp socket shown in FIG. 1.
Figure 4:
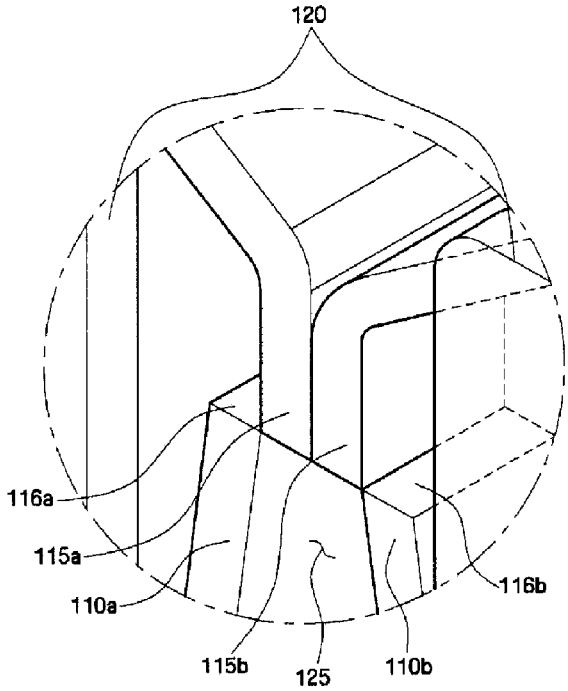
FIG. 4 is a partial perspective view showing an enlarged version of a region A of FIG. 1.
Figure 5:
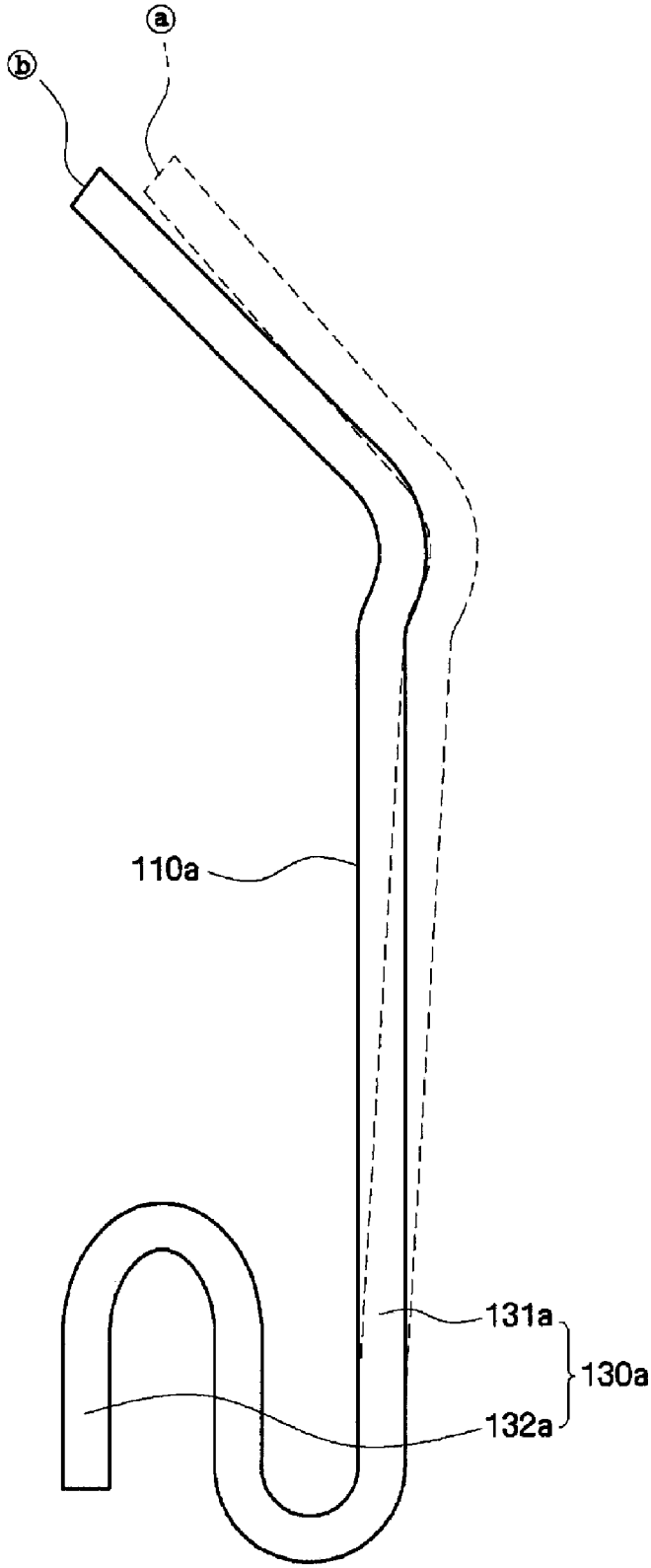
FIG. 5 is a view for explaining bending characteristics of a first connection terminal and a first elastic portion included in the lamp socket of FIG. 1.

Hereinafter, a lamp socket 100 according to a first exemplary embodiment of the present invention will be described in detail with reference to FIGS. 1 through 5. FIG. 1 is a first perspective view of the lamp socket 100 according to the first exemplary embodiment of the present invention. FIG. 2 is a second perspective view of the lamp socket 100 shown in FIG. 1. FIG. 3 is a front view of the lamp socket 100 shown in FIG. 1. FIG. 4 is a partial perspective view showing an enlarged version of a region A of FIG. 1. FIG. 5 is a view for explaining bending characteristics of a first connection terminal 110*a* and a first elastic portion 130*a* included in the lamp socket 100 of FIG. 1.

Referring to FIGS. 1 and 2, the lamp socket 100 fixes each of lamps 70 (see FIG. 16) and supplies power to each of the lamps 70. The lamp socket 100 includes a body portion 150, first connection terminal 110*a*, second connection terminal 110*b*, first elastic portion 130*a*, second elastic portion 130*b*, stop portion 120, and fixing portions 141*a* through 141*d*. The lamp socket 100 may be made of a conductive material such as metal. The body portion 150, the first connection terminal 110*a*, the second connection terminal 110*b*, the first elastic portion 130*a*, the second elastic portion 130*b*, the stop portion 120, and the fixing portions 141*a* through 141*d* may be integrated with each other, that is, they may be formed from a single metal sheet.

The first connection terminal 110*a* and the second connection terminal 110*b* fix a terminal of each of the lamps 70 and supply power to each of the lamps 70. The first and second connection terminals 110*a* and 110*b* press toward each other with a terminal of each of the lamps 70 interposed therebetween, thereby fixing the terminal of each of the lamps 70. The first and second connection terminals 110*a* and 110*b* extend from the body portion 150. The first and second elastic portions 130*a* and 130*b* are formed between the body portion 150 and the first and second connection terminals 110*a* and 110*b*, respectively.

The first and second connection terminals 110*a* and 110*b* are connected respectively to the first and second elastic portions 130*a* and 130*b*, hold a terminal of each of the lamps 70 similar to a pair of tongs, and thus fix the terminal of each of the lamps 70 to the lamp socket 100. Accordingly, each of the lamps 70 can be easily fixed to or removed from the lamp socket 100. The first and second elastic portions 130*a* and 130*b* are connected to, and integrally formed with, the body portion 150.

The body portion 150 maintains the basic framework of the lamp socket 100. The first connection terminal 110*a*, the second connection terminal 101*b*, the stop portion 120, and the fixing portions 141*a* through 141*d* are connected to the body portion 150.

The body portion 150 may be shaped like a box that has a space surrounded by four sidewalls. The body portion 150 may be formed by bending a single metal board. The stop portion 120, the first connection terminal 110*a*, and the second connection terminal 110*b* extend from an upper end of the body portion 150, and the fixing portions 141*a* through 141*d* extend from a lower end of the body portion 150.

The first and second elastic portions 130*a* and 130*b* deliver sufficient elastic forces to the first and second connection terminals 110*a* and 110*b*, respectively. Specifically, to adequately hold a terminal of each of the lamps 70, the first and second connection terminals 110*a* and 110*b* should have sufficient elasticity, or flexibility. When the first and second connection terminals 110*a* and 110*b* do not have sufficient elasticity, it is not easy to insert or remove a terminal of each of the lamps 70 into or from the lamp socket 100. Furthermore, each of the lamps 70 can easily slip off of the lamp socket 100.

To have sufficient elasticity, the first and second connection terminals 110*a* and 110*b* may be made of a sufficiently elastic or compliant material, and/or may be appropriately shaped.

The first and second connection terminals 110*a* and 110*b* may be made of a metal material. However, it is desirable to shape the first and second connection terminals 110*a* and 110*b* such that they can maintain appropriate rigidity and elasticity. In the configuration shown, the first and second elastic portions 130*a* and 130*b* are formed such that they can deliver appropriate rigidity and elasticity to the first and second connection terminals 110*a* and 110*b*.

To make a display device 1 (see FIG. 17) ultra-slim, a height of the lamp socket 100 is preferably minimized. However, to minimize the height of the lamp socket 100, lengths of the first and second connection terminals 110*a* and 110*b* should be reduced, and when the lengths of the first and second connection terminals 110*a* and 110*b* are reduced, they are often made less compliant. To solve this problem, the first and second connection terminals 110*a* and 110*b* may respectively have first and second elastic portions 130*a* and 130*b* which, in this configuration, are bent at least twice in order make them more flexible.

In the configuration of FIGS. 2-3, each of the first and second elastic portions 130*a* and 130*b* is formed in a general "S" shape. When each of the first and second elastic portions 130*a* and 130*b* is bent in an "S" shape, the height of the lamp socket 100 can be reduced, and the first and second elastic portions 130*a* and 130*b* can deliver sufficient elastic forces to the first and second connection terminals 110*a* and 110*b*, respectively. To minimize the height of the lamp socket 100, the first and second elastic portions 130*a* and 130*b* may also be formed at least partially within the body portion 150. In fact, if each of the first and second elastic portions 130*a* and 130*b* extends from the upper end of the body portion 150, at least one end thereof may be formed within the body portion 150.

Each of the first and second elastic portions 130*a* and 130*b* may be formed by bending an end of the body portion 150 into a general "S" shape. The first and second elastic portions 130*a* and 130*b* substantially function as springs. Therefore, an end of the body portion 150 may be bent at least three times to form more compliant/flexible first and second elastic portions 130*a* and 130*b*.

In this embodiment, fixing portions 141*a* through 141*d* support the body portion 150 and fix the lamp socket 100. Here, fixing portions 141*a* through 141*d* extend downward from the lower end of the body portion 150 and are bent outward from the body portion 150. One or more fixing portions 141*a* through 141*d* may be formed under the body portion 150 and may be bent radially from the body portion 150.

The fixing portions 141*a* through 141*d* are integrally formed with the body portion 150 and may also function as terminals to which power is supplied from an external source.

Referring to FIGS. 1 and 3, the stop portion 120 is formed at the front (as viewed in FIG. 1) of the body portion 150. The stop portion 120 extends from the upper end of the body portion 150. The stop portion 120 is plate-shaped, and helps to both maintain the framework of the lamp socket 100, and prevent the movement of a terminal of each of the lamps 70. Specifically, the stop portion 120 includes a terminal insertion groove 125 which is cut into an upper end thereof.

The stop portion 120 prevents a terminal of a lamp 70, which is fixed between the first and second connection terminals 110*a* and 110*b*, from slipping downward. Therefore, the terminal of each of the lamps 70 is inserted into the terminal insertion groove 125 and fixed by the first and second connection terminals 110*a* and 110*b*. The terminal insertion groove 125 may be formed as a generally "U" shaped cutout in the stop portion 120.

A distance D between highest and lowest points of each of the first and second elastic portions 130*a* and 130*b* may be any suitable distance, but in particular can be approximately 30 to 50% of a total height H of the lamp socket 100. This imparts sufficient flexibility to the first and second connection terminals 110*a* and 110*b* while also significantly reducing the total height H of the lamp socket 100.

Referring to FIGS. 3 and 4, the lamp socket 100 includes a first blocking portion 115*a* and a second blocking portion 115*b* which prevent terminals of the lamps 70 from slipping upward. Each of the first and second blocking portions 115*a* and 115*b* is formed on a side of one of the first and second connection terminals 110*a* and 110*b*. Specifically, the first blocking portion 115*a* is formed on a side of the first connection terminal 110*a* and protrudes toward the second connection terminal 110*b*. The second blocking portion 115*b* is formed on a side of the second connection terminal 110*b* and protrudes toward the first connection terminal 110*a*.

As shown in FIG. 4, each of the first and second blocking portions 115*a* and 115*b* may be formed by bending an end of one of the first and second connection terminals 110*a* and 110*b*. Specifically, the first and second blocking portions 115*a* and 115*b* diverge from ends of the first and second connection terminals 110*a* and 110*b* at first and second sections 116*a* and 116*b* and thus are misaligned with the first and second connection terminals 110*a* and 110*b*, respectively. Therefore, a terminal of each of the lamps 70, interposed between the first and second connection terminals 110*a* and 110*b*, is disposed under the first and second blocking portions 115*a* and 115*b*. In this manner, the first and second blocking portions 115*a* and 115*b* prevent the terminal of each of the lamps 70 from slipping upward.

Bending characteristics of the first connection terminal 110*a* and the first elastic portion 130*a* will now be described with reference to FIG. 5. Referring to FIG. 5, since the first connection terminal 110*a* extends from the first elastic portion 130*a*, its height can be lowered while its actual length remains unchanged.

The first elastic portion 130*a* includes a first portion 131*a* connected to the first connection terminal 110*a* and a second portion 132*a* connected to the body portion 150 (see FIG. 3). The first and second portions 131*a* and 132*a* at least partially overlap each other. The first and second portions 131*a* and 132*a* may substantially be integrally formed with the first connection terminal 110*a* and the body portion 150. As can be seen, elastic forces can be transmitted between the first and second portions 131*a* and 132*a* of the first elastic portion 130.

When a terminal of each of the lamps 70 is inserted into the lamp socket 100, the first connection terminal 110*a* is moved from its initial ⓐ position to a ⓑ position (positions shown are illustrative, and not necessarily shown to scale). Here, a force applied to the first connection terminal 110*a* to move the first connection terminal 110*a* from the ⓐ position to the ⓑ position is stored in the first elastic portion 130*a* in the form of elastic potential energy. The first elastic portion 130*a* is thus a kind of spring, and the elastic energy stored in the first elastic portion 130*a* allows the terminal of each of the lamps 70 to be inserted into or removed from the lamp socket 100 with an appropriate force. In other terms, first elastic portion 130*a* acts as a type of spring. Thus, when a terminal of lamp 70 is inserted into the lamp socket 100, pushing first connection terminal 110*a* leftward when viewed as in the perspective of FIG. 5, the elastic portion 130*a* exerts an opposing force that pushes terminal 110*a* against the terminal of lamp 70, securing the terminal.

Hereinafter, a balance board 10 according to an exemplary embodiment of the present invention will be described with reference to FIGS. 6 and 7.

Figure 6:
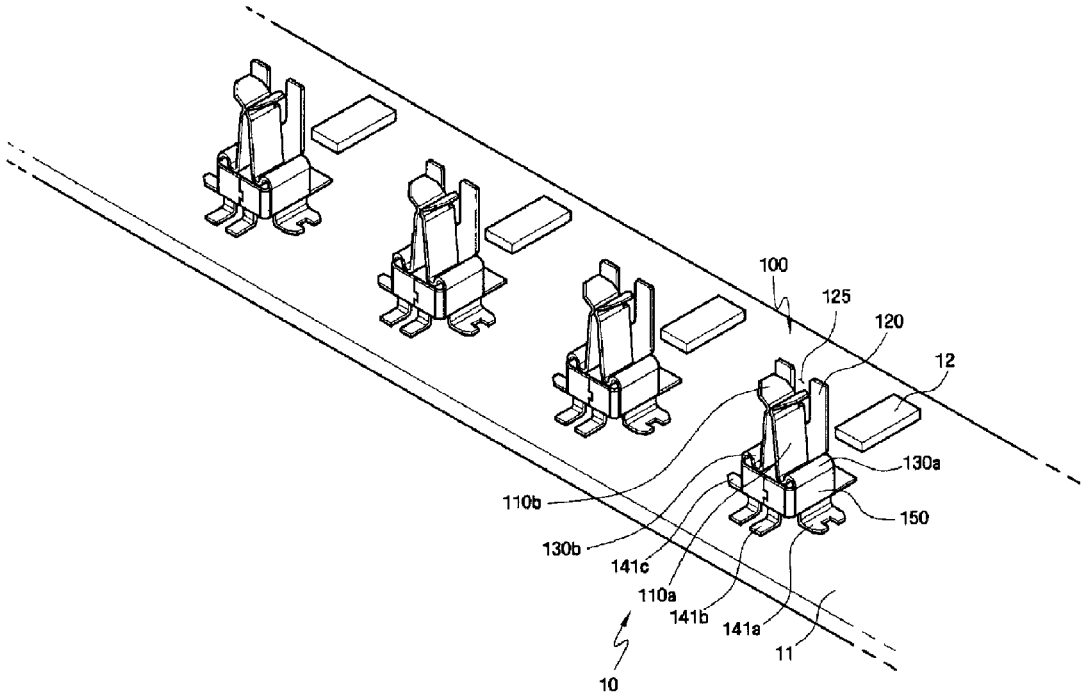
FIG. 6 is a perspective view of a balance board on which the lamp socket of FIG. 1 is mounted.
Figure 7:
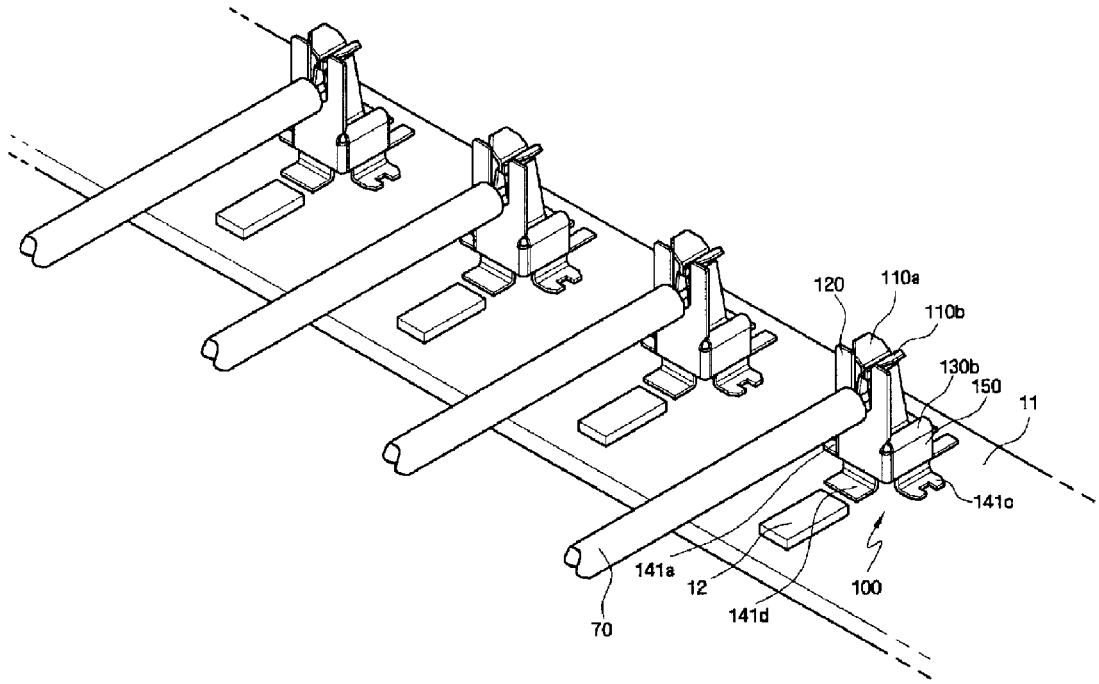
FIG. 7 is a rear perspective view of the balance board shown in FIG. 6.

Referring to FIGS. 6 and 7, the balance board 10 receives a driving voltage from an inverter (not shown) and supplies a uniform driving current to each of the lamps 70. The balance board 10 includes a plurality of lamp sockets 100, each connected to a terminal of one of the lamps 70. To supply a uniform driving current to each lamp 70, the balance board 10 may include balance coils or capacitors. Thus, a driving voltage applied to the balance board 10 is provided to the lamps 70 via the balance coils or the capacitors.

In the present specification, the balance board 10 including capacitors will be described as an example. However, the present invention is not limited to this example, the description of the balance board 10 may also be applied to a balance board including balance coils.

The balance board 10 includes a circuit board 11, lamp sockets 100, and capacitors 12. The circuit board 11 is made of an insulator, and the lamp sockets 100 are mounted on a surface of the circuit board 11. The lamp sockets 100, in particular the fixing portions 141*a* through 141*d*, may be adhered to the circuit board 11 using known surface mount technology. As described above, the fixing portions 141*a* through 141*d* can extend from the body portion 150 of each of the lamp sockets 100. The number and size of the fixing portions 141*a* through 141*d* may vary according to a force required to fix each of the lamp sockets 100 to the circuit board 11.

The fixing portions 141*a* through 141*d* may be adhered to the surface of the circuit board 11 using a known floor dip method or a floor solder method. The surface mount technology enables the lamp sockets 100 to be affixed to the circuit board 11 with an automatic device.

The capacitors 12 are mounted on the circuit board 11. The capacitors 12 are used to supply a uniform driving current to the lamp sockets 100, respectively. A terminal of each of the capacitors 12 is connected to one of the lamp sockets 100, and the other terminal thereof is connected to a power source. The capacitors 12 may be connected to the lamp sockets 100, respectively. The capacitors 12 are not necessarily mounted on the circuit board 11. When desired, the capacitors 12 may be mounted on the lamp sockets 100, respectively. Alternatively, each of the capacitors 12 may be formed at an end of one of the lamps 70.

The capacitors 12 may be, for example, multi-layer ceramic capacitors (MLCCs). An MLCC uses multiple layers of high-k ceramic materials as dielectrics that are interposed between electrodes. The MLCC may be small in size but have high capacitance.

Figure 8:
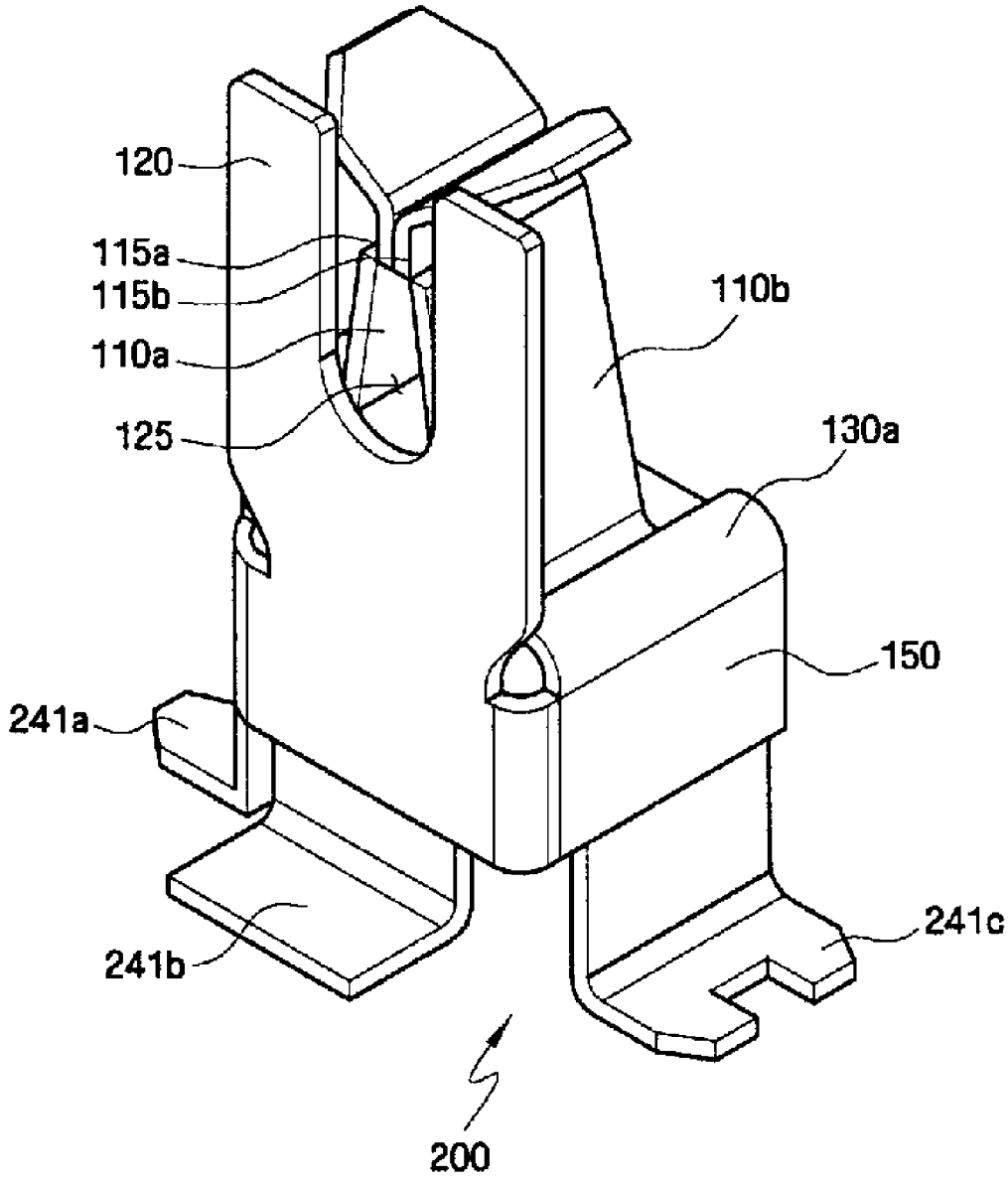
FIG. 8 is a perspective view of a lamp socket according to a second exemplary embodiment of the present invention.
Figure 9:
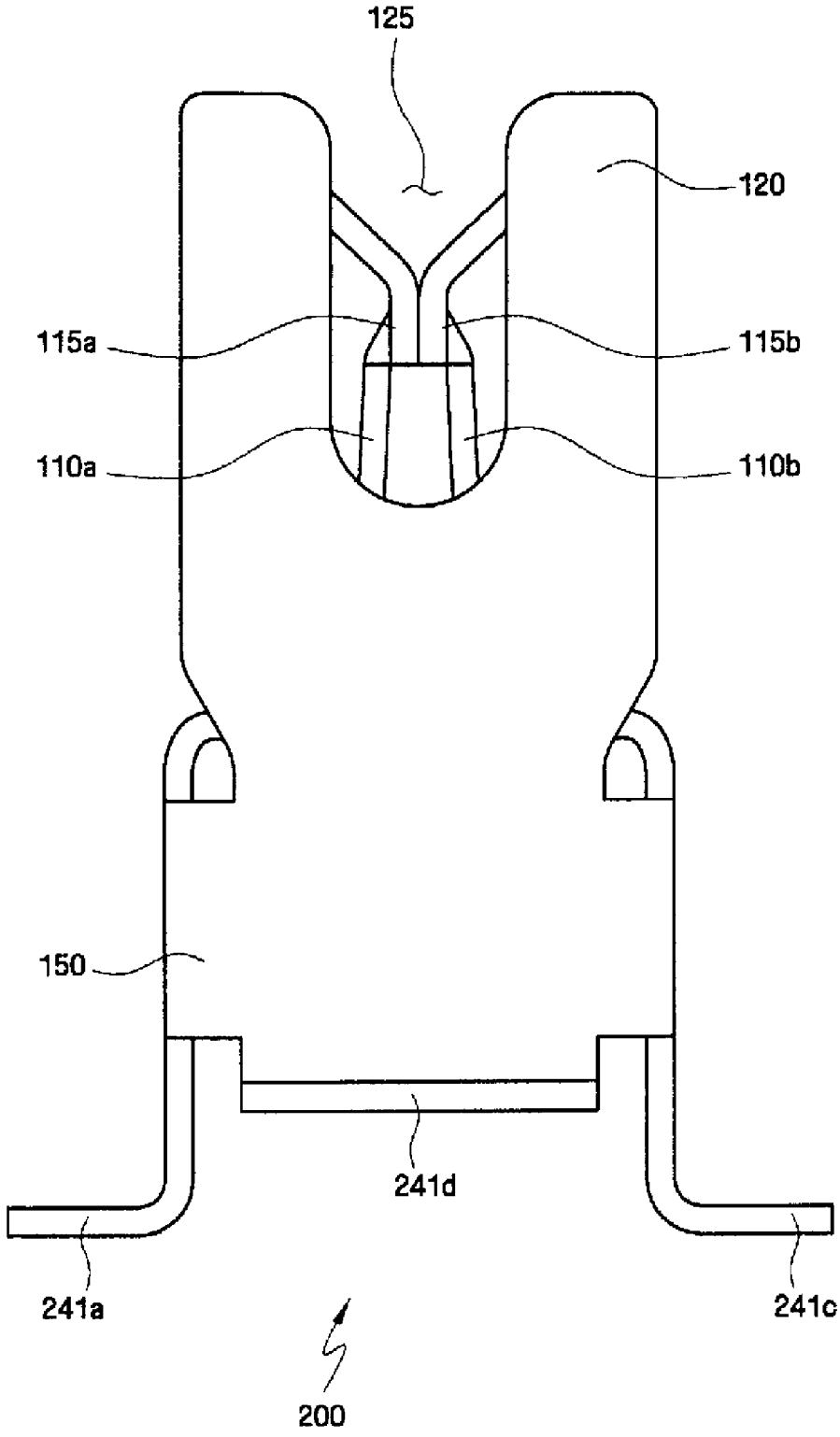
FIG. 9 is a front view of the lamp socket shown in FIG. 8.
Figure 10:
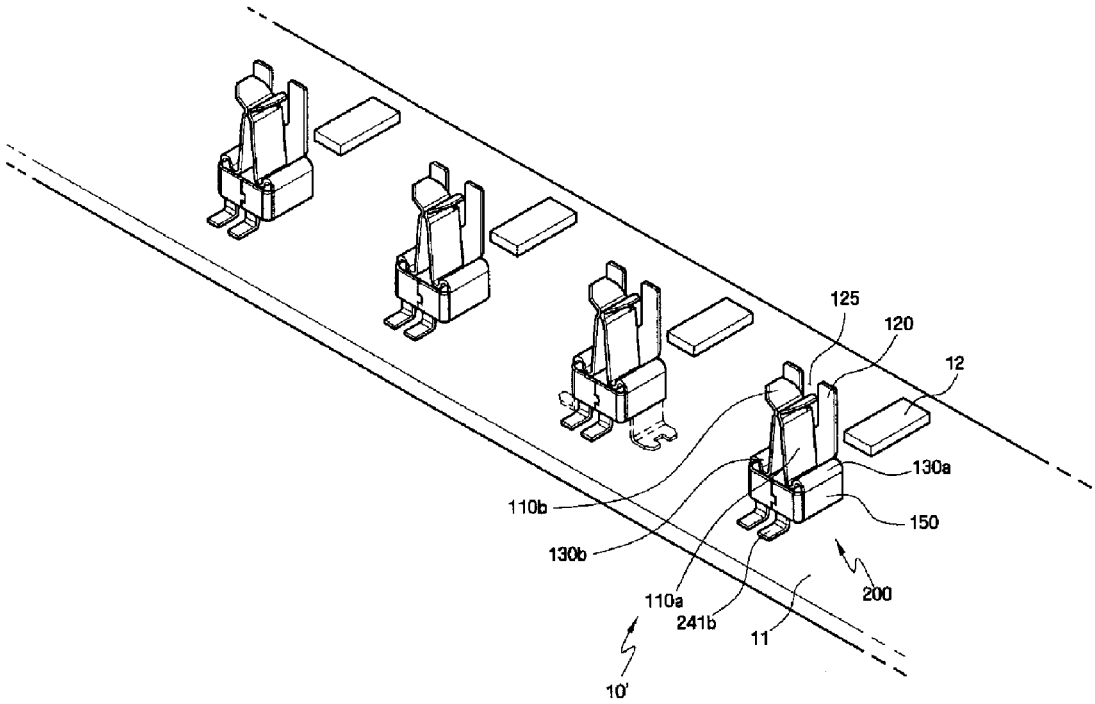
FIG. 10 is a perspective view of a balance board on which the lamp socket of FIG. 8 is mounted.
Figure 11:
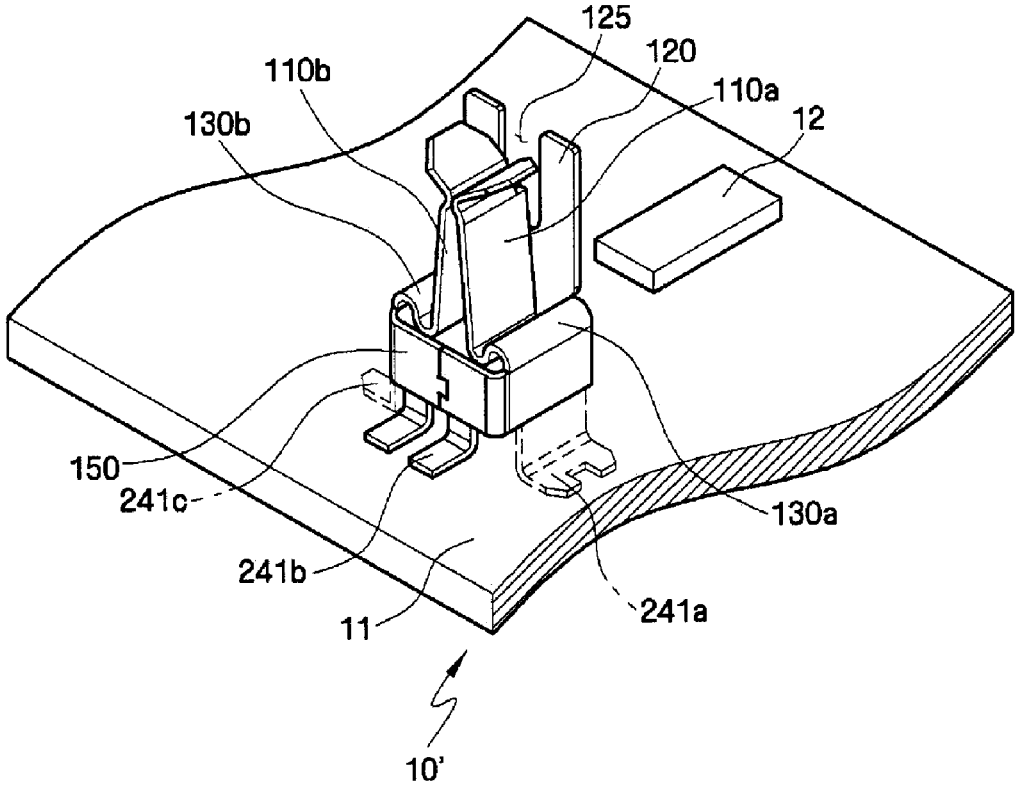
FIG. 11 is an enlarged perspective of a region of the balance board shown in FIG. 10.

Hereinafter, a lamp socket 200 according to a second exemplary embodiment of the present invention will be described in detail with reference to FIGS. 8 through 11. FIG. 8 is a perspective view of the lamp socket 200 according to the second exemplary embodiment of the present invention. FIG. 9 is a front view of the lamp socket 200 shown in FIG. 8. FIG. 10 is a perspective view of a balance board 10' on which the lamp socket 200 of FIG. 8 is mounted. FIG. 11 is an enlarged perspective of a region of the balance board 10' shown in FIG. 10. For simplicity, elements substantially identical to those of the lamp socket 100 according to the first exemplary embodiment are indicated by like reference numerals, and thus their description will be omitted.

Referring to FIGS. 8 and 9, at least some of fixing portions 241*a* through 241*d* of the lamp socket 200 extend through circuit board 11 (see FIG. 10), helping to fix them to the circuit board 11.

The lamp socket 200 includes a body portion 150, a first connection terminal 110*a*, a second connection terminal 110*b*, a first elastic portion 130*a*, a second elastic portion 130*b*, a stop portion 120, and the fixing portions 241*a* through 241*d*. The lamp socket 200 may be made of a conductive material such as a metal. The body portion 150, the first connection terminal 110*a*, the second connection terminal 110*b*, the first elastic portion 130*a*, the second elastic portion 130*b*, the stop portion 120, and the fixing portions 241*a* through 241*d* may be integrated with each other, that is, they may be formed by performing sheet metal working on a single sheet of metal.

The first and second connection terminals 110*a* and 110*b* press against each other with a terminal of each of the lamps 70 interposed therebetween, thereby fixing the terminal of each of the lamps 70. The first and second connection terminals 110*a* and 110*b* extend from the body portion 150. The first and second elastic portions 130*a* and 130*b* are formed between the body portion 150 and the first and second connection terminals 110*a* and 110*b*, respectively.

The body portion 150 maintains the basic framework of the lamp socket 200. The first connection terminal 110*a*, the second connection terminal 101*b*, the stop portion 120, and the fixing portions 241*a* through 241*d* are connected to the body portion 150.

The body portion 150 may be shaped like a box that has a space surrounded by four sidewalls. The body portion 150 may be formed by bending a single metal board. The stop portion 120, the first connection terminal 110*a*, and the second connection terminal 110*b* extend from an upper end of the body portion 150, and the fixing portions 241*a* through 241*d* extend from a lower end of the body portion 150.

The first and second connection terminals 110*a* and 110*b* may respectively have first and second elastic portions 130*a* and 130*b* that are bent at least twice. A cross section of each of the first and second elastic portions 130*a* and 130*b* may be bent into an "S" shape. When each of the first and second elastic portions 130*a* and 130*b* is bent in an "S" shape, the height of the lamp socket 200 can be reduced, and the first and second elastic portions 130*a* and 130*b* can deliver sufficient elastic forces to the first and second connection terminals 110*a* and 110*b*, respectively.

The fixing portions 241*a* through 241*d* support the body portion 150 and fix the lamp socket 200. The fixing portions 241*a* through 241*d* extend downward from the lower end of the body portion 150 and are bent outward from the body portion 150. One or more fixing portions 241*a* through 241*d* may be formed under the body portion 150 and may be bent radially from the body portion 150.

The fixing portions 241*a* through 241*d* are integrally formed with the body portion 150 and may function as terminals to which power is supplied from an external source. Some of the fixing portions 241*a* through 241*d* may be attached to the circuit board 11 using surface mount technology, and others of the fixing portions 241*a* through 241*d* may penetrate the circuit board 11 and thus be fixed to the circuit board 11.

Hereinafter, the balance board 10' of the second exemplary embodiment will be described in further detail with reference to FIGS. 10 and 11.

Referring to FIGS. 10 and 11, the balance board 10' includes a plurality of lamp sockets 200, each connected to a terminal of one of the lamps 70. To supply a uniform driving current to each lamp 70, the balance board 10' may include balance coils or capacitors. Thus, a driving voltage applied to the balance board 10' is provided to the lamps 70 via the balance coils or the capacitors.

The balance board 10' includes a circuit board 11, lamp sockets 200, and capacitors 12. Here, the fixing portions 241*b* and 241*d* of each of the lamp sockets 200 may be attached to the circuit board 11 using surface mount technology, and the fixing portions 241*a* and 241*c* of each of the lamp sockets 200 may extend through the circuit board 11 for more secure attachment to the circuit board 11.

Each of the lamp sockets 200 should not only supply power to a corresponding one of the lamps 70, but also physically support both ends of the corresponding one of the lamps 70. Therefore, to prevent the lamp sockets 200 from being disconnected from the circuit board 11 due to impact, at least some (241*a* and 241*c*) of the fixing portions 241*a* through 241*d* are mechanically coupled to the circuit board 11. The lamp sockets 200 may be automatically assembled using an automatic machine.

Figure 12:
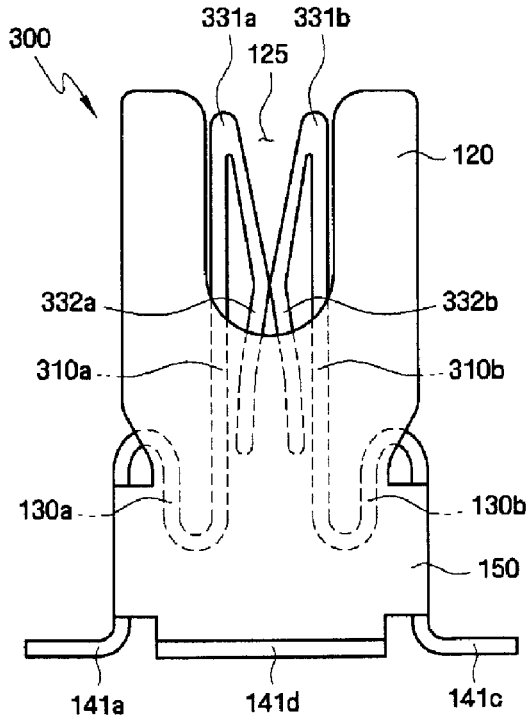
FIG. 12 is a front view of a lamp socket according to a third exemplary embodiment of the present invention.

Hereinafter, a lamp socket 300 according to a third exemplary embodiment of the present invention will be described in detail with reference to FIG. 12. FIG. 12 is a front view of a lamp socket 300 according to the third exemplary embodiment of the present invention. For simplicity, elements substantially identical to those of lamp socket 100 are indicated by like reference numerals, and thus their description will be omitted.

Referring to FIG. 12, the lamp socket 300 of the third embodiment includes a first auxiliary elastic portion 331*a* and a second auxiliary elastic portion 331*b* to increase the flexibility of a first connection terminal 310*a* and a second connection terminal 310*b*, respectively.

The lamp socket 300 includes a body portion 150, first connection terminal 310*a*, second connection terminal 310*b*, first elastic portion 130*a*, second elastic portion 130*b*, first auxiliary elastic portion 331*a*, second auxiliary elastic portion 331*b*, stop portion 120, and fixing portions 141*a* through 141*d*. The lamp socket 300 may be made of a conductive material such as a metal. The body portion 150, the first connection terminal 310*a*, the second connection terminal 310*b*, the first elastic portion 130*a*, the second elastic portion 130*b*, the first auxiliary elastic portion 331*a*, the second auxiliary elastic portion 331*b*, the stop portion 120, and the fixing portions 141*a* through 141*d* may be integrated with each other. That is, they may be formed by working a single metal sheet.

The first and second connection terminals 310*a* and 310*b* press against each other with a terminal of a lamp 70 interposed therebetween, thereby fixing or securing the terminal. The first and second connection terminals 310*a* and 310*b* extend from the body portion 150. The first and second elastic portions 130*a* and 130*b* are formed between the body portion 150 and the first and second connection terminals 310*a* and 310*b*, respectively.

A cross section of each of the first and second elastic portions 130*a* and 130*b* may be bent into an "S" shape. When each of the first and second elastic portions 130*a* and 130*b* is bent in an "S" shape, the height of the lamp socket 300 can be reduced, and the first and second elastic portions 130*a* and 130*b* can deliver sufficient elastic forces to the first and second connection terminals 310*a* and 310*b*, respectively.

The first auxiliary elastic portion 331*a* may be formed between the first elastic portion 130*a* and the first connection terminal 310*a*, and the second auxiliary elastic portion 331*b* may be formed between the second elastic portion 130*b* and the second connection terminal 310*b*. The first and second auxiliary elastic portions 331*a* and 331*b* are used to confer added flexibility, so as to allow for more precise control of contact pressure between the first and second connection terminals 310*a* and 310*b*.

The first and second auxiliary elastic portions 331*a* and 331*b* may be bent, for example, into a "U" shape, as shown. However, the present invention is not limited to this example, and, when necessary, the first and second auxiliary elastic portions 331*a* and 331*b* may be bent any number of times to provide any degree of desired flexibility.

The fixing portions 141*a* through 141*d* are integrally formed with the body portion 150 and may function as terminals to which power is supplied from an external source. Some of the fixing portions 141*a* through 141*d* may be adhered onto the circuit board 11 using surface mount technology, and the other ones of the fixing portions 141*a* through 141*d* may penetrate the circuit board 11 and thus be fixed to the circuit board 11.

Figure 13:
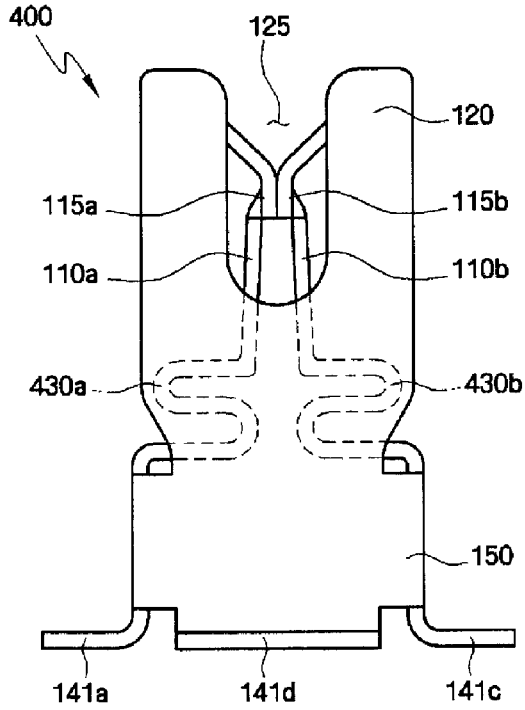
FIG. 13 is a front view of a lamp socket according to a fourth exemplary embodiment of the present invention.

Hereinafter, a lamp socket 400 according to a fourth exemplary embodiment of the present invention will be described in detail with reference to FIG. 13. FIG. 13 is a front view of the lamp socket 400 according to the fourth exemplary embodiment of the present invention. For simplicity, elements substantially identical to those of the lamp socket 100 according to the first exemplary embodiment are indicated by like reference numerals, and thus their description will be omitted.

Referring to FIG. 13, in lamp socket 400, a first elastic portion 430*a* and a second elastic portion 430*b* are bent generally perpendicular to a first connection terminal 310*a* and a second connection terminal 310*b*, respectively.

The lamp socket 400 includes a body portion 150, first connection terminal 310*a*, second connection terminal 310*b*, first elastic portion 430*a*, second elastic portion 430*b*, a stop portion 120, and fixing portions 141*a* through 141*d*. The lamp socket 400 may be made of a conductive material such as metal, and may be formed by working a single metal sheet.

Since the first and second elastic portions 430*a* and 430*b* are formed perpendicular to the first and second connection terminals 310*a* and 310*b*, respectively, the total height of the lamp socket 400 can be reduced.

Figure 14:
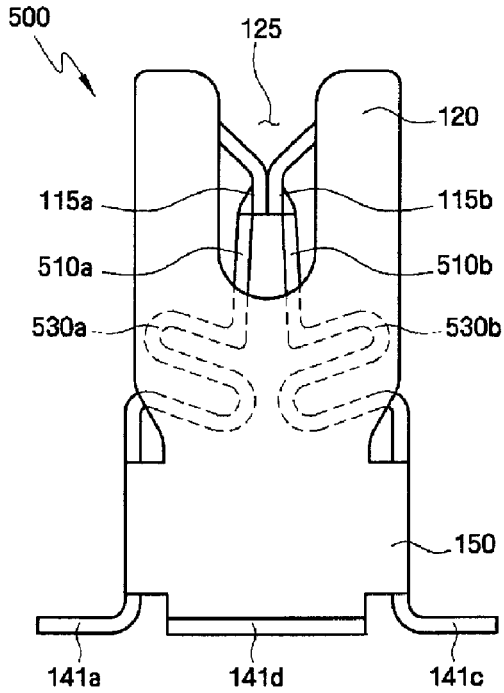
FIG. 14 is a front view of a lamp socket according to a fifth exemplary embodiment of the present invention.

Hereinafter, a lamp socket 500 according to a fifth exemplary embodiment of the present invention will be described in detail with reference to FIG. 14. FIG. 14 is a front view of the lamp socket 500 according to the fifth exemplary embodiment of the present invention. For simplicity, elements substantially identical to those of the lamp socket 100 according to the first exemplary embodiment are indicated by like reference numerals, and thus their description will be omitted.

Referring to FIG. 14, in the lamp socket 500, a first elastic portion 530*a* and a second elastic portion 530*b* are bent generally obliquely to a first connection terminal 510*a* and a second connection terminal 510*b*, respectively.

Since the first and second elastic portions 530*a* and 530*b* are formed obliquely to the first and second connection terminals 510*a* and 510*b*, respectively, the space in which the first and second elastic portions 530*a* and 530*b* are formed can be more effectively utilized. That is, the first and second elastic portions 530*a* and 530*b*, which are inserted into the lamp socket 500, should be formed as long as possible to obtain sufficient elasticity. Here, if the first and second elastic portions 530*a* and 530*b* are formed obliquely to the first and second connection terminals 510*a* and 510*b* as shown, they are more flexible without adding to the overall height of lamp socket 500. Accordingly, this embodiment provides a further approach to enhancing the space efficiency of lamp sockets without compromising performance.

Figure 15:
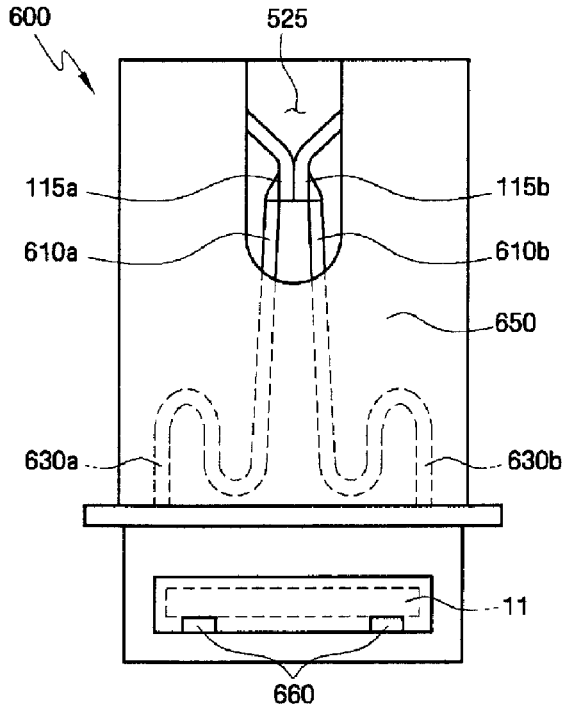
FIG. 15 is a front view of a lamp socket according to a sixth exemplary embodiment of the present invention.

Hereinafter, a lamp socket 600 according to a sixth exemplary embodiment of the present invention will be described in detail with reference to FIG. 15. FIG. 15 is a front view of the lamp socket 600 according to the sixth exemplary embodiment of the present invention. For simplicity, elements substantially identical to those of the lamp socket 100 according to the first exemplary embodiment are indicated by like reference numerals, and thus their description will be omitted.

Referring to FIG. 15, the lamp socket 600 includes a body portion 650 which is made of an insulator and houses a first connection terminal 610*a*, a second connection terminal 610*b*, a first elastic portion 630*a*, and a second elastic portion 630*b*.

The lamp socket 600 includes the first connection terminal 610*a*, second connection terminal 610*b*, first elastic portion 630*a*, and second elastic portion 630*b* within the body portion 650. Here, body portion 650 is made of an insulator. A terminal insertion groove 625 is formed in the body portion 650. An inverter 11 is inserted into a lower portion of the lamp socket 600, and terminals 660 which may contact the inverter 11 are formed in the lower portion of the lamp socket 600.

Figure 16:
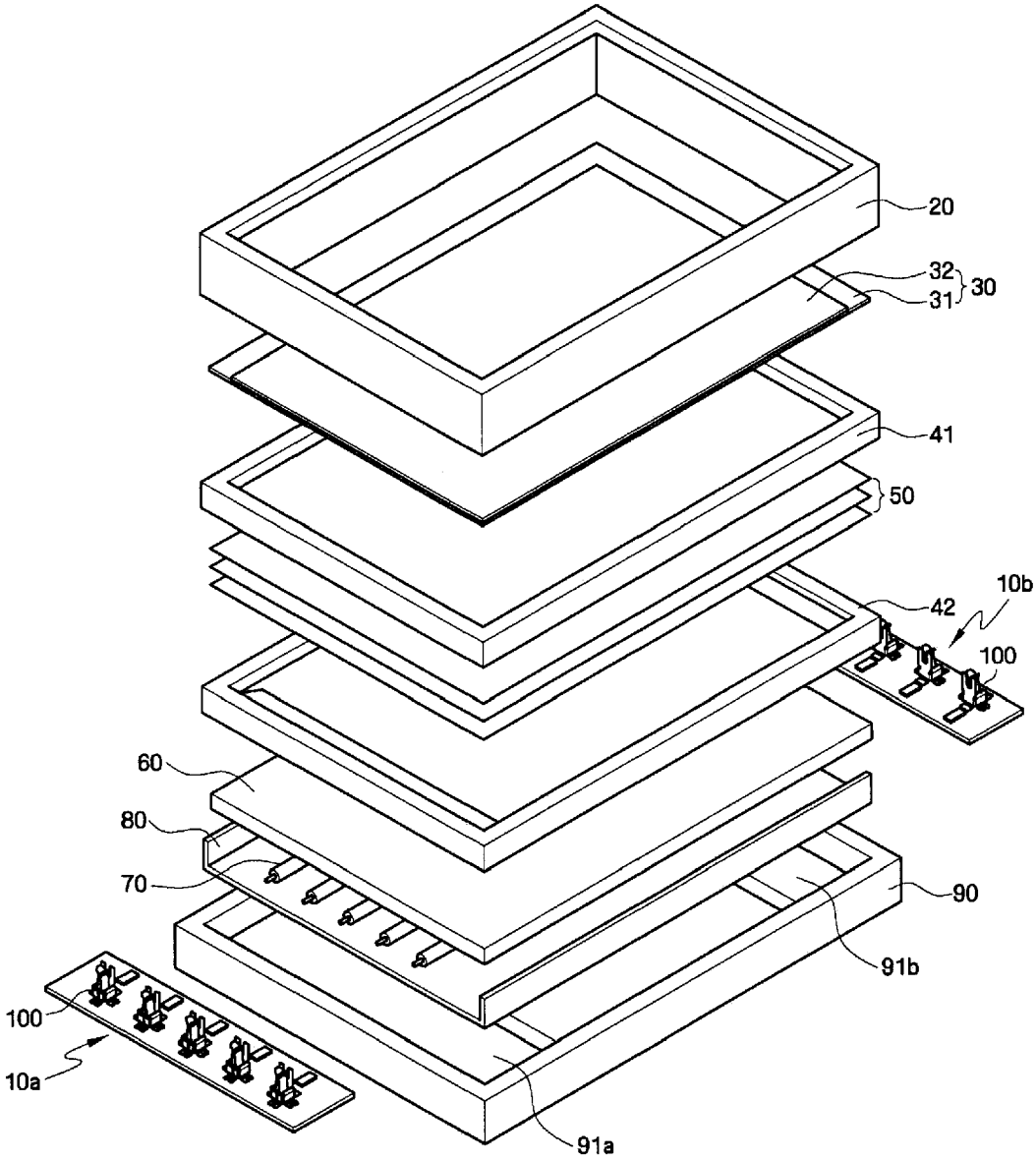
FIG. 16 is an exploded perspective view of a display device according to an exemplary embodiment of the present invention.
Figure 17:
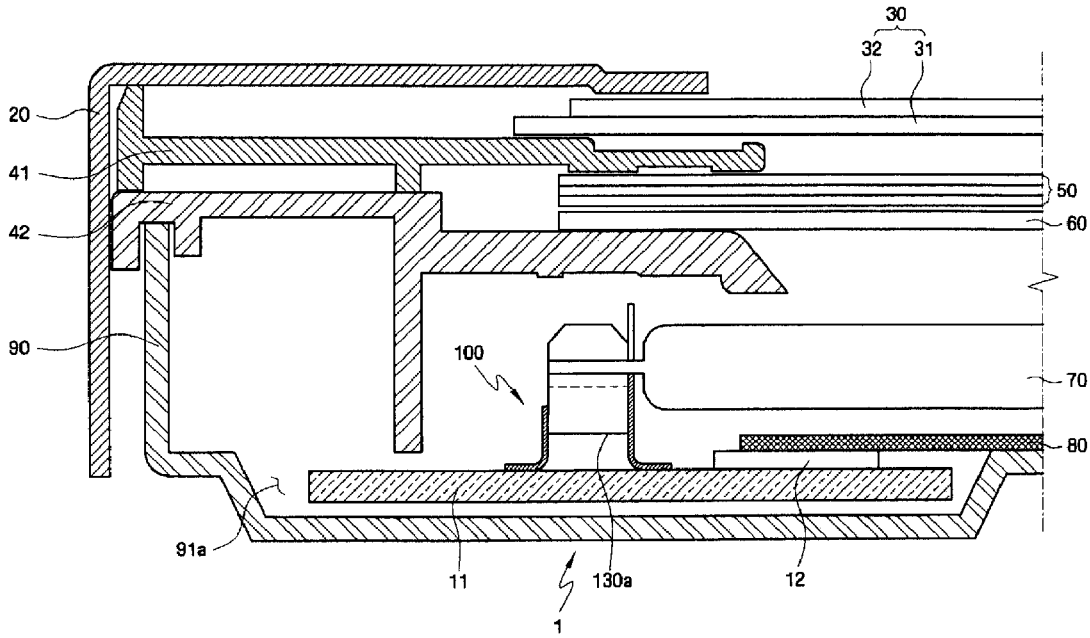
FIG. 17 is a cross-sectional view of the display device shown in FIG. 16.

Hereinafter, a display device incorporating exemplary embodiments of the present invention will be described in detail with reference to FIGS. 16 and 17. FIG. 16 is an exploded perspective view of such a display device 1. FIG. 17 is a cross-sectional view of the display device 1 shown in FIG. 16.

The display device 1 of the present embodiment includes a display panel 30, an upper housing 20, a first frame 41, optical sheets 50, a diffusion plate 60, a second frame 42, the lamps 70, balance boards 10*a* and 10*b*, a reflective sheet 80, and a lower housing 90.

The display panel 30 includes a lower panel 31, which has gate lines (not shown), data lines (not shown) and a thin-film transistor (TFT) array, and an upper panel 32 which has a black matrix and a common electrode and faces the lower panel 31. The display panel 30 displays image information.

The upper housing 20 forms the exterior of the display device 1 and has a space to accommodate the display panel 30. In addition, an open window is formed in the center of the upper housing 20 to expose the display panel 30.

The upper housing 20 is coupled to the lower housing 90. When necessary, the first and second frames 41 and 42, which accommodate the display panel 30 and the optical sheets 50, may be interposed between the upper housing 20 and the lower housing 90.

The optical sheets 50 diffuse and concentrate light that is received from the diffusion plate 60. The optical sheets 50 are disposed on the diffusion plate 60 and housed within the upper and lower housings 20 and 90. The optical sheets 50 include a first prism sheet, a second prism sheet, and a protective sheet.

The first and second prism sheets refract light that passed through the diffusion plate 60 and concentrate the light, which is incident at a low angle, to the front of the display device 1, thereby enhancing the brightness of the display device 1 within a range of effective viewing angles.

The protective sheet is formed on the first and second prism sheets. The protective sheet not only protects surfaces of the first and second prism sheets, but also diffuses light in order for uniform distribution of the light. The configuration of the optical sheets 50 is not limited to the above example, and may vary according to specifications of the display device 1.

The diffusion plate 60 diffuses light, which is emitted from the lamps 70, in all directions. The diffusion plate 60 prevents bright lines, which are bright portions formed after the shapes of the lamps 70, from being seen from the front of the display device 1.

The lamps 70 may be cold cathode fluorescent lamps (CCFLs), hot cathode fluorescent lamps (HCFLs), or the like. When the lamps 70 are HCFLs, each of the HCFLs has two terminals at each of both ends thereof. Each of the terminals is inserted into one of lamp sockets 100 so as to be supplied with power.

The lamp sockets 100 are mounted on a circuit board 11 to form each of the balance boards 10*a* and 10*b*. The balance boards 10*a* and 10*b* are inserted respectively into board insertion grooves 91*a* and 91*b* which are formed in a floor surface of the lower housing 90. Here, an insulating pad (not shown) may be interposed between the balance boards 10*a* and 10*b* and the lower housing 90.

While the present invention has been particularly shown and described with reference to exemplary embodiments thereof, it will be understood by those of ordinary skill in the art that various changes in form and detail may be made therein without departing from the spirit and scope of the present invention as defined by the following claims. Additionally, the dimensions and arrangement of the components shown in each embodiment are exemplary, and the invention contemplates various other such dimensions and arrangements for each embodiment shown or not shown. For example, it is understood that shapes described as "S" or "U" shapes need not have any particular set of dimensions, but rather that this description is merely that of a general shape. The exemplary embodiments should be considered in a descriptive sense only and not for purposes of limitation.

What is claimed is:

1. A lamp socket, comprising:

a body portion;

a connection terminal for connection of the lamp socket to a terminal of a lamp;

a compliant portion which connects the body portion and the connection terminal and comprises a first portion connected to the connection terminal and a second portion connected to the body portion; and one or more fixing portions which extend from the body portion, wherein the first portion and the second portion at least partially overlap each other;

wherein at least a portion of the connection terminal is positioned above both the body portion and the compliant portion, and wherein the connection terminal contacts the terminal of the lamp when the lamp terminal is fixedly inserted into the lamp socket.

2. The lamp socket of claim 1, wherein the compliant portion is bent at least twice.

3. The lamp socket of claim 1, wherein a cross section of the compliant portion is bent generally in an "S" shape.

4. The lamp socket of claim 1, further comprising an auxiliary compliant portion between the compliant portion and the connection terminal, wherein a cross section of the auxiliary compliant portion is bent generally in a "U" shape.

5. The lamp socket of claim 1, wherein the connection terminal comprises a first connection terminal and a second connection terminal which are symmetrical to each other, wherein the first connection terminal and the second connection terminal press the terminal of the lamp against each other so as to facilitate a fixing of the terminal of the lamp.

6. The lamp socket of claim 5, wherein the first connection terminal further comprises a first blocking portion disposed on the terminal of the lamp and protruding toward the second connection terminal, and wherein the second connection terminal is disposed on the terminal of the lamp and protrudes toward the first connection terminal.

7. The lamp socket of claim 6, wherein the first blocking portion is formed by bending an end of the first connection terminal.

8. The lamp socket of claim 1, wherein a distance between a highest point and a lowest point of the compliant portion is 30 to 50% of a total height of the lamp socket.

9. The lamp socket of claim 1, wherein the compliant portion is oriented generally horizontal to the connection terminal, generally perpendicular to the connection terminal, or generally oblique to the connection terminal.

10. The lamp socket of claim 1, wherein the body portion is integrally formed with the connection terminal, and the compliant portion is integrally formed with the fixing portions.

11. The lamp socket of claim 1, wherein the body portion is made of an insulator.

12. The lamp socket of claim 1, wherein an elastic force acts between the first and second portions of the compliant portion.

* * * * *